US007025445B2

(12) United States Patent
Thielman et al.

(10) Patent No.: US 7,025,445 B2
(45) Date of Patent: Apr. 11, 2006

(54) GAS ACTUATED INK LINE VALVE

(75) Inventors: Jeffrey L. Thielman, Corvallis, OR (US); Rhonda L. Wilson, Monmouth, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 258 days.

(21) Appl. No.: 10/199,154

(22) Filed: Jul. 19, 2002

(65) Prior Publication Data

US 2004/0012655 A1 Jan. 22, 2004

(51) Int. Cl.
*B41J 2/175* (2006.01)

(52) U.S. Cl. ..... 347/85

(58) Field of Classification Search ..... 347/85, 347/86, 19, 7, 5, 6, 84, 89, 30, 17, 104, 23, 347/20, 38; 216/27; 438/21
See application file for complete search history.

(56) References Cited

U.S. PATENT DOCUMENTS

| | | | | |
|---|---|---|---|---|
| 4,558,326 | A * | 12/1985 | Kimura et al. | 347/30 |
| 5,380,175 | A * | 1/1995 | Amarume | 417/553 |
| 5,598,198 | A * | 1/1997 | Taylor et al. | 347/85 |
| 6,010,210 | A * | 1/2000 | Wilson et al. | 347/85 |
| 6,116,723 | A * | 9/2000 | Childers | 347/85 |
| 6,130,695 | A * | 10/2000 | Childers et al. | 347/85 |
| 6,234,616 | B1 * | 5/2001 | Komuro et al. | 347/85 |
| 6,585,358 | B1 * | 7/2003 | Usui et al. | 347/85 |

FOREIGN PATENT DOCUMENTS

| | | | | |
|---|---|---|---|---|
| JP | 10 138 506 | * | 5/1998 | 347/85 |

* cited by examiner

*Primary Examiner*—Stephen Meier
*Assistant Examiner*—An H. Do

(57) ABSTRACT

Apparatus and methods are disclosed for preventing depriming of inkjet printheads in a printing system having a pressurized ink delivery system when the pressurizing gas is turned off. Normally-closed gas-actuated valves are disposed in the ink lines from the ink containers to the printheads; the valves are kept in an open state during printing by the same pressurizing gas that is utilized to pressurize the ink delivery system.

13 Claims, 6 Drawing Sheets

GAS ACTUATED INK LINE VALVE

FIELD OF THE INVENTION

The present invention relates generally to printing systems, and more particularly, to a method, system and means for preventing a printhead from drawing gas from an ink line when a printer is turned off.

BACKGROUND OF THE INVENTION

High throughput printing systems, such as those used in high speed printers, color copiers, or large format devices, put heavy demand on an ink delivery system. The printhead must operate at a very high frequency. At the same time, print quality expectations keep rising. In order to maintain high print quality, the printhead must be able to rapidly eject ink without causing large fluctuations in the printhead pressure level.

One approach to this is to provide a pressure regulator integral to the printhead. The regulator receives ink at a first pressure and delivers ink to the printhead at a controlled second pressure. In order for this control to work, the first pressure must always be greater than the second pressure. Because of dynamic pressure drops, very high pixel rate printing requires that the first pressure be at a positive gauge pressure. Thus, the ink containers of such printers may be pressurized, such as with compressed gas, to forceably expel ink from the containers. An example of such a printing system is provided in U.S. Pat. No. 6,010,210, "Ink Container Having a Multiple Function Chassis."

In printing systems where gas pressure is used to expel ink from a collapsible supply bag, a pressure drop is present across the bag which changes as the ink in the bag is depleted. As the bag is emptied, greater pressure is required to force the remaining ink out of the bag. The relationship between the pressure drop across the bag and the quantity of remaining ink is described in co-pending U.S. patent application Ser. No. 09/888,716, "Pressure Based Ink Level Detector and Method."

When an ink bag in an ink supply has collapsed and is substantially empty and the gas pressure driving the ink through the ink lines is removed, a negative pressure may be created in the ink supply line from the ink container to the printhead. If this negative pressure exceeds the capillary pressure of the ink within the printhead, air may be drawn into the printhead through the printhead nozzles, causing printhead "deprime". Subsequent use of the printhead can then result in degraded print quality or permanent damage to the printhead.

There are a number of prior art solutions to this problem. One such prior art solution includes stranding extra ink in the ink supply so that when the printer is turned off and the supplies are depressurized the negative pressure is not generated. This is a wasteful solution and is not operable for highly accurate ink level systems. Another prior art solution is to maintain the ink supplies close to the printhead in the Z direction, such that any negative pressure generated by the collapsing bag is countered by a pressure due to gravity. This solution works as long as there is sufficient room to keep the ink supplies at approximately the same elevation as the printhead. However, this solution typically requires a larger footprint for the printer.

A further prior art solution is to add a valve in the ink line and additional printer electronics and firmware to actuate a solenoid or motor to open and close the valve. When a motor is used, it is necessary to track position and, if the printer loses power, the valve may be left open. Using a solenoid still requires a separate actuation, so that it is possible for the valve to be left open or closed at the wrong time. If the valve is closed during printing due to a software or electrical defect, a set of very expensive printheads may be damaged or destroyed due to pen starvation, or "dry fire". If the valve is left open when the printer is turned off, then printhead damage could occur due to the negative pressure generated by the ink supply.

An additional prior art solution is simply to use human actuation of ink valves. This solution would require the user to actuate the ink valves when removing the supplies. To prevent drawing air into the printhead, the method would require either the use of an idle pressurization of the ink supplies or keeping the supplies close in elevation to the printhead.

Thus, there is a need for apparatus and methods which reliably prevent negative pressure in a supply line from drawing ink out of a printer printhead when the printer is powered down.

SUMMARY OF THE INVENTION

The present invention comprises, in one embodiment, a method for preventing an inkjet printhead from drawing air when a printer is turned off, comprising: disposing a normally closed valve in an ink line from an ink supply to the printhead; and opening the valve with gas pressure during ink supply pressurization.

The present invention comprises in a further embodiment, a system for supplying ink, comprising: an ink source; a gas pressure source for pressurizing the ink supply when operative; an ink line from the ink supply; and a valve in the ink line operative directly or indirectly by the gas pressure source.

The present invention in a further embodiment comprises a system for supplying ink, comprising: means for supplying ink; means for pressurizing the ink supply when operative; and means for communicating ink to the printhead only when the ink supply is pressurized.

The present invention in a further embodiment, comprises a valve for controlling ink flow from an ink source to a printhead, comprising: a valve body with a chamber therein, the chamber having an input aperture for receiving ink from the ink source and an exit aperture for providing ink to the printhead; a diaphragm connected to form a subchamber that includes the input aperture and the exit aperture within the chamber; and a plug assembly including a plug for closing a selected one of the apertures, wherein the plug assembly maintains the plug in a normally closed position across the selected aperture; and an actuation mechanism to pull the plug away from the selected aperture.

DETAILED DESCRIPTION OF THE INVENTION

Figure 1:
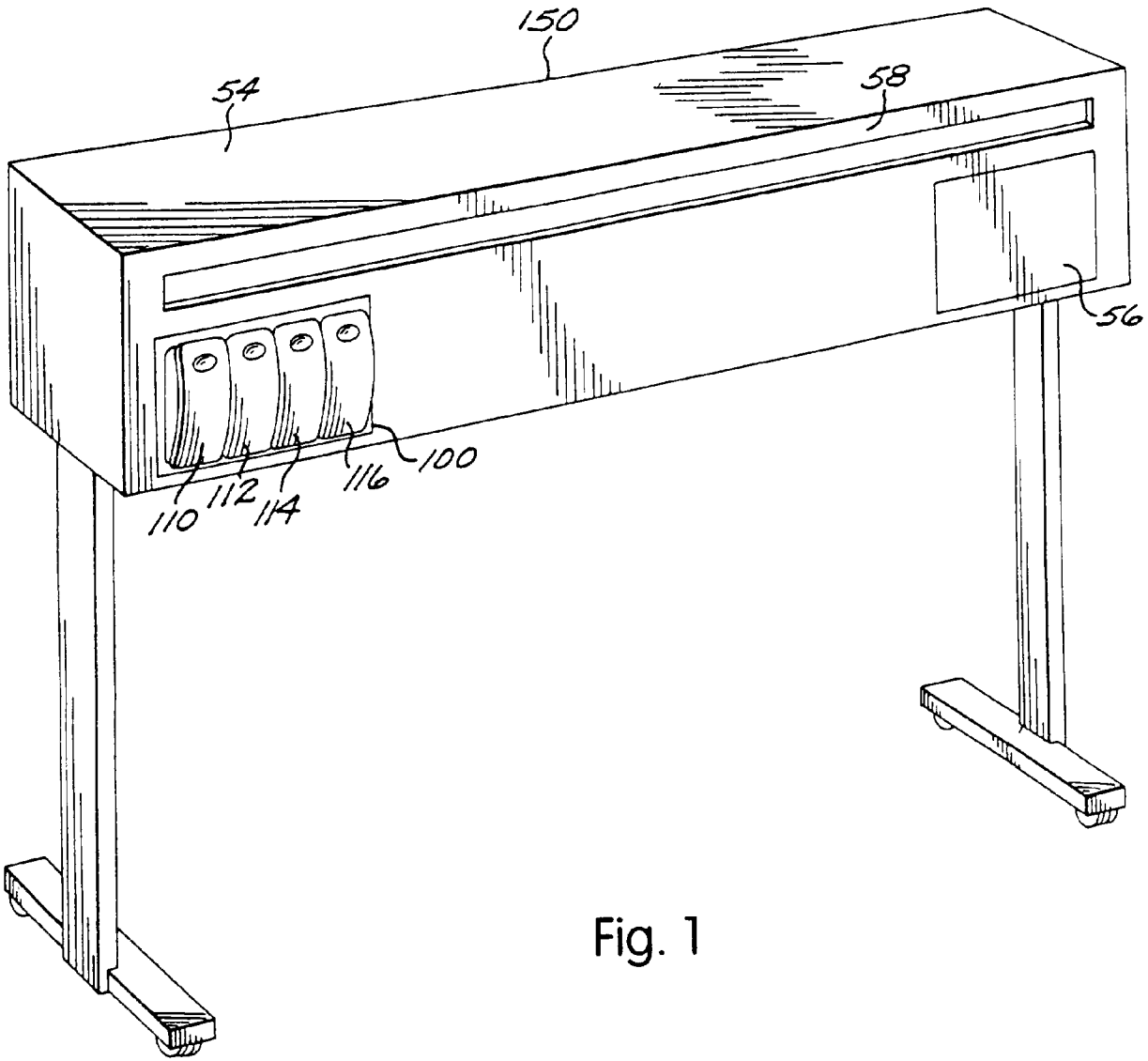
FIG. 1 is a simplified isometric view of an exemplary printer/plotter in which the present invention may be employed.

FIG. 1 shows in isometric view an exemplary form of a large scale format printer/plotter system 150, wherein four off-carriage ink containers 110, 112, 114, 116 are shown in place in the ink supply station. The system includes a housing 54, a front control panel 56 which provides user control switches, and a media output slot 58 through which the media is output from the system after the printing operation. This exemplary system is fed from a media roll; alternatively sheet fed systems can also be used.

Figure 2:
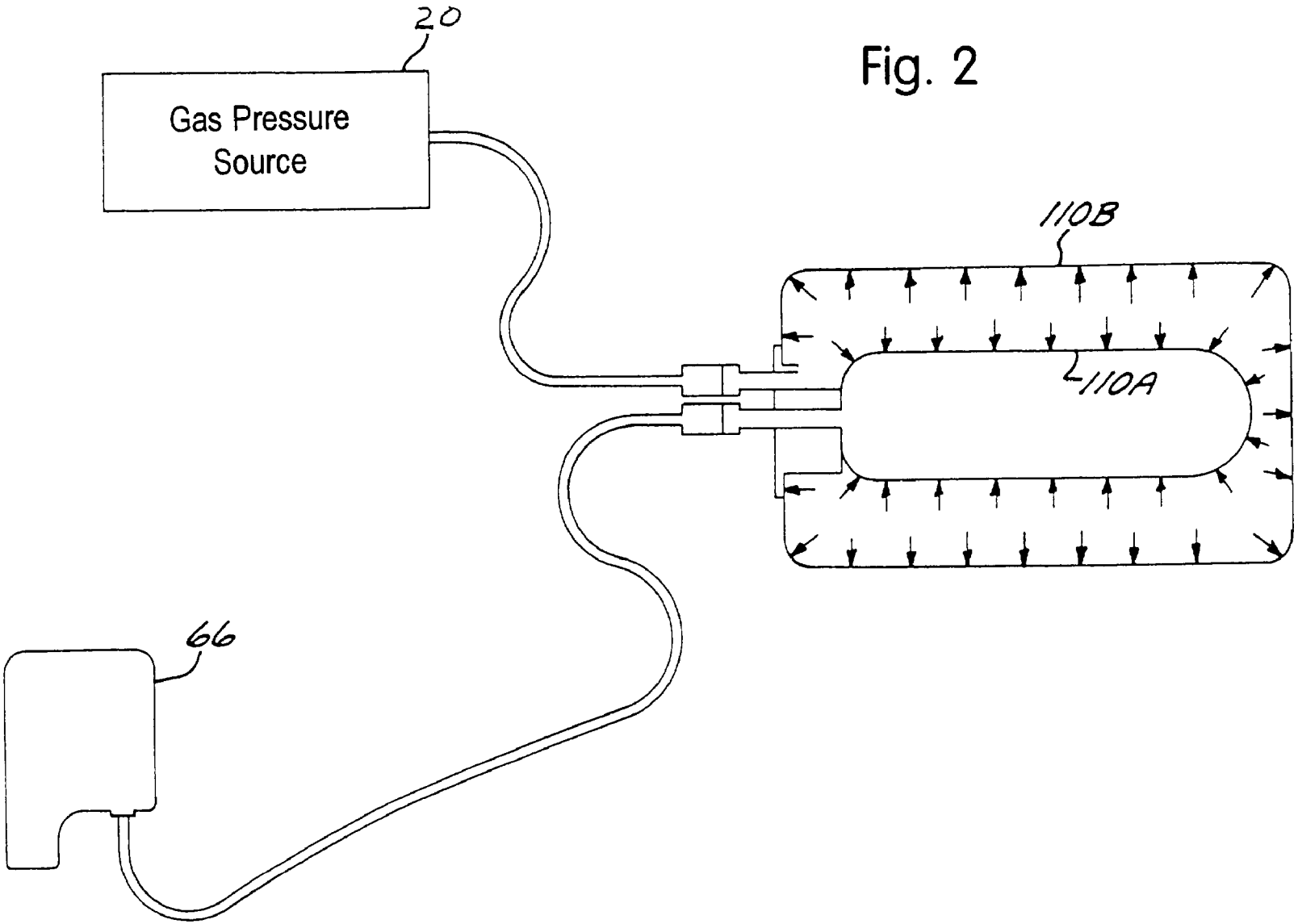
FIG. 2 is schematic block diagram illustrating in a simplified fashion an exemplary off-carriage ink container, with connection to an on-carriage print cartridge, and an air compressor for pressuring the off-carriage pressure vessel comprising the off-carriage ink container.

FIG. 2 is a simplified diagrammatic view illustrating the gas pressure source 20, the print head 66, and an exemplary ink supply. The ink supply comprises a flexible inner reservoir 110A within a rigid outer container 110B. When printing, compressed gas from the pressure source 20 is forced into the space between the flexible inner reservoir 110A and the rigid outer container 110B, thus forcing ink to the printhead 66. During idle periods, the region between the reservoir bag and the pressure vessel is allowed to depressurize. During shipping of the ink container 110A, the supply is not pressurized.

Figure 3:
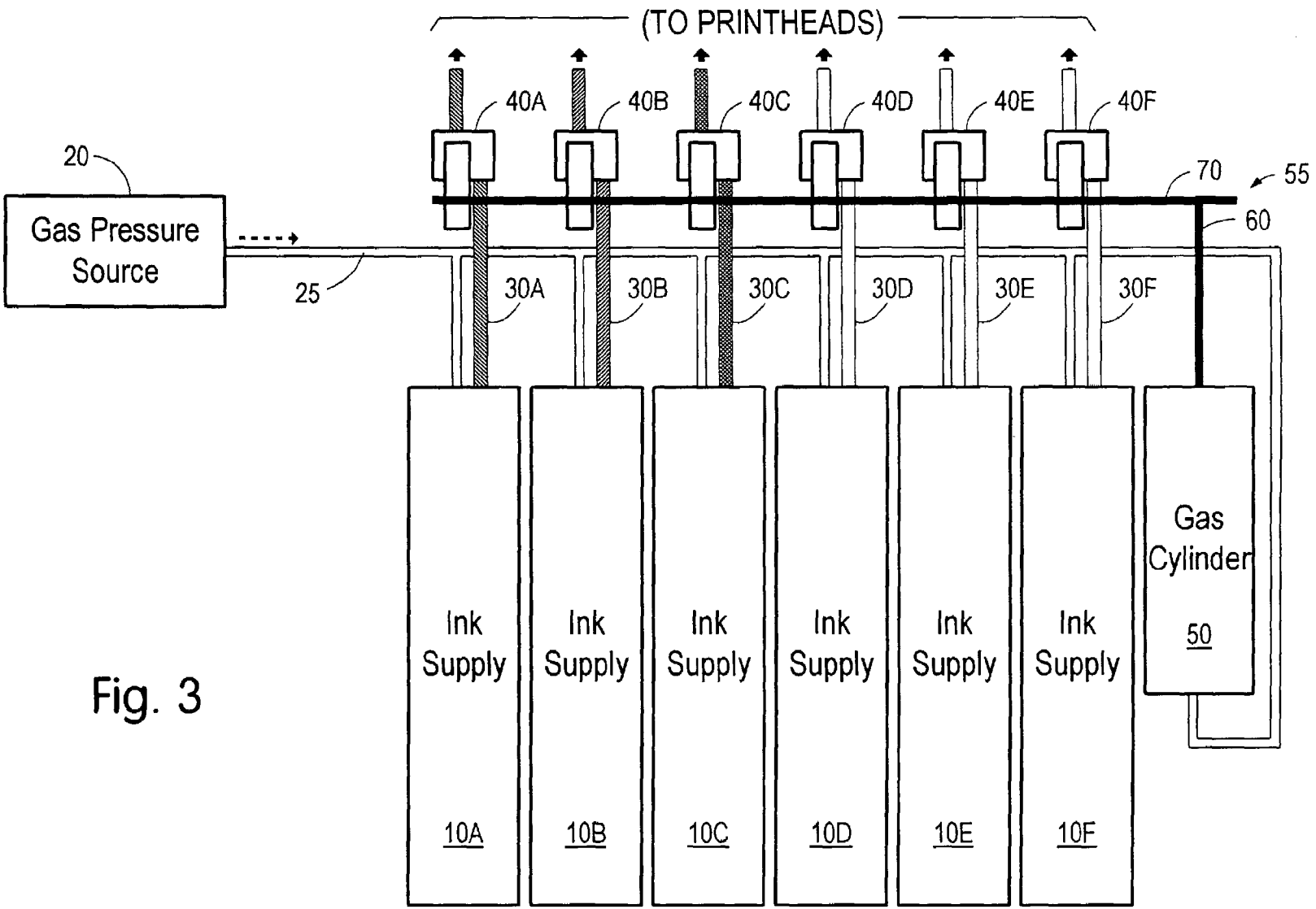
FIG. 3 is a schematic block diagram of one exemplary embodiment of the present invention.

FIG. 3 illustrates an exemplary embodiment of the present invention. The system comprises one or more ink supplies 10A–10F, a gas pressure source 20 for pressurizing the ink supply 10 when operative, an ink line 30A–30F from the ink supply 10, and one or more valves 40A–40F in the one or more ink lines 30A–30F and operative directly or indirectly by the pressure source 20. This configuration facilitates a method for preventing a printhead from drawing air when a printer is turned off. This method may comprise the steps of disposing a normally closed valve 40 in an ink line 30 from an ink supply 10 to the printhead, and opening the valve 40 with gas pressure during the ink supply pressurization. Although six ink supplies are shown in FIG. 3, the apparatus and methods of the invention may be used with different printer configurations having a different number of ink supplies.

In one embodiment of the present invention, a gas cylinder 50, such as an air cylinder, may be connected to receive gas pressure from the pressure source 20, and may be further connected on its output side by a mechanism 55 to operate the one or more ink valves 40A–40F. In the embodiment shown in FIG. 3, the mechanism 55 comprises the rod 60 driven by the gas pressure cylinder 50, and a rod 70 for simultaneously actuating a plurality of ink valves 40A–40F, and various other elements to be discussed below with respect to FIGS. 4 and 6.

Figure 4:
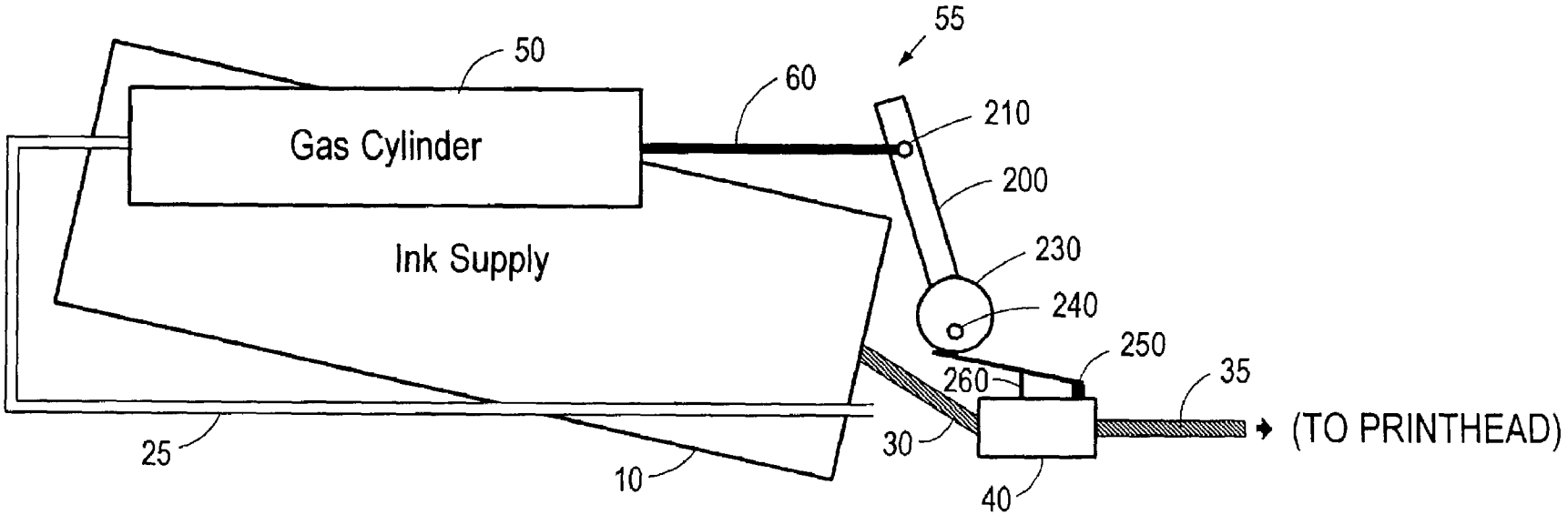
FIG. 4 is a schematic diagram of a side view of the embodiment of the invention shown in FIG. 3.

One embodiment for implementing the direct or indirect actuation mechanism 55 is shown in FIG. 4. Common numbers are used to designate the same elements in each of FIGS. 3 and 4. Accordingly, the ink supply 10 is shown, as well as the pressurization line 25 from the gas pressure source 20, as well as the gas cylinder 50. Line 25 provides gas pressure from gas pressure source 20 to the one or more ink supplies 10A–10F as well as to the gas cylinder 50. The gas cylinder 50 drives the mechanism 55 to actuate the one or more valves 40A–40F.

In the embodiment shown in FIG. 4, the mechanism 55 comprises a rod 60 connected to directly or indirectly actuate a cam 230 for opening and closing the ink valve 40. In the embodiment of FIG. 4, the rod 60 is connected to a second rod 200 at a pivot point 210. One end of the rod 200 is connected to an offset axis 240 of the cam 230. When the rod 60 is pushed laterally outward, the rod 200 moves, thereby causing the offset cam 230 to rotate about its offset axis 240 to move a further rod 250 up or down. The rod 250 in the embodiment example of FIG. 4 has a pivot point at one end thereof and is operable to move up and down a further rod 260 which extends into the ink valve 40. This up and down motion of the rod 260 causes the opening and closing of the ink valve 40.

Figure 5:
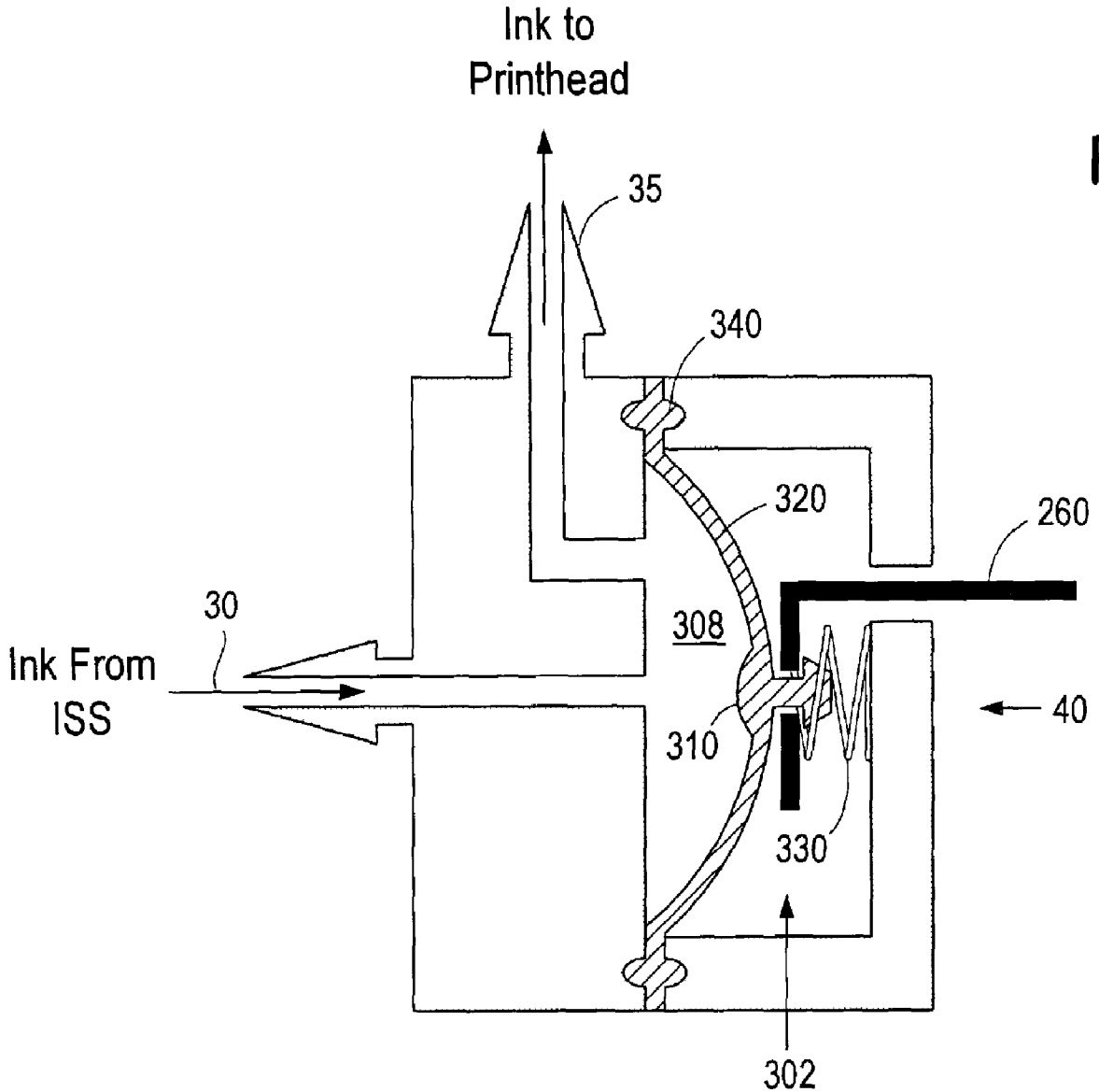
FIG. 5 is a schematic diagram of one embodiment of an ink valve in an open position which may be utilized to implement the present invention.

A variety of different ink valves may be utilized to implement the ink valve 40. In the embodiment of FIG. 4, up and down motion of a rod opens and closes the ink valve 40. One embodiment of an ink valve 40 that may be utilized to implement the embodiment shown in FIG. 4, is illustrated in FIG. 5. The valve 40 comprises a valve body 300 which includes an ink chamber 302 with a subchamber 308 thereof into which ink flows from the ink line 30 via an input aperture 304. Ink is sent to the printhead from the subchamber 308 of the chamber 302 through an exit aperture 306, e.g., there is fluid communication between each of the apertures 304 and 306 via the subchamber 308. By way of example, but not by way of limitation, the embodiment of FIG. 5 includes a valve plug assembly including a valve plug 310 of any convenient shape disposed to be moved to block ink from one of the ink line 30 from entering through the aperture 304 into the subchamber 308 or the exit aperture 306 to prevent ink from exiting the subchamber 308. This valve plug 310 is moved into place by means of the up and down motion of the rod 260. Note that the valve body 300 which may be made of any convenient material including a barrier plastic, by way of example.

In the example embodiment shown in FIG. 5, a barrier diaphragm 320 is connected to form the subchamber 308 within the chamber 302. The diaphragm 320 includes at an appropriate location thereon the valve plug 310. In the embodiment of FIG. 5, the valve plug assembly further comprises a spring 330 provided in order to implement a normally closed valve configuration which is only opened by means of the movement of the rod 260. Note that other convenient arrangements may be used in the valve plug assembly to maintain the plug in a normally closed position. In one embodiment of the diaphragm 320 a high barrier elastomer may be utilized as the diaphragm material. A typical elastomer might be butyl rubber, or EPDM, or nitrile. Additionally, elastomer ribs 340 may be disposed to form a good seal at the edges of the bladder 320.

Figure 6:
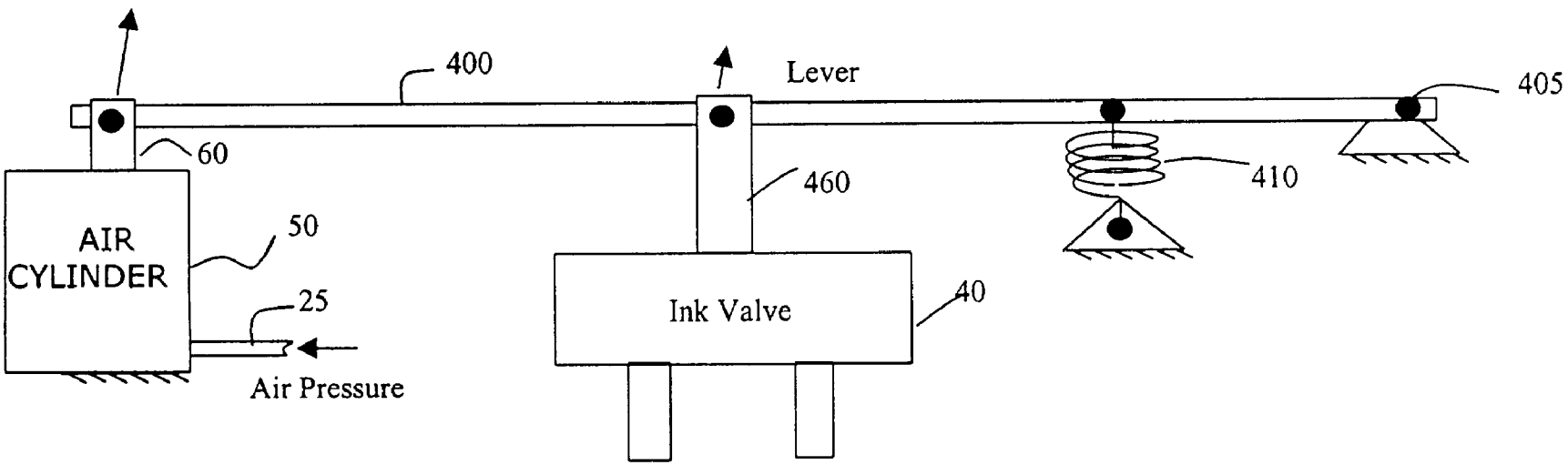
FIG. 6 is a schematic diagram of another embodiment of the mechanism for operating a valve associated therewith.

Referring to FIG. 6, there is shown a further embodiment of the actuation mechanism 55 for the valve 40. In this embodiment, the actuation mechanism 55 includes a rod 60 and the rod 400 which operates as a lever about a pivot point 405. The lever 400 may be spring loaded by means of a spring 410. The lever 400 is connected by means of a rod 460 to open and close the ink valve 40. Accordingly, when the gas cylinder 50 drives the rod 60 outward, the lever 400 moves in such a fashion as to pull the rod 460 away from the ink valve 40 and thereby open the valve.

Accordingly, in one embodiment of the invention, a way is provided to prevent the drawing of air into a printhead when the printer is turned off and ink supplies are depressurized. The ink valves will open whenever there is pressure applied to the ink system and close whenever the pressure drops below a threshold point. An advantage of this embodiment is that the gas actuation of the embodiments prevents failures due to incorrect opening and closing of the ink valves. The air cylinder will remain open as long as the supply is pressurized. When the printer is turned off, or when an ink supply is changed, the ink system will be depressurized and the ink valve will automatically close, at a pressure slightly less than when it opened because of hysteresis. An advantage of some embodiments of the present invention is that because the air actuator system would open and close the ink valve slower relative to other actuated ink valve systems, there would be a lower likelihood of having pressure spikes.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A valve for controlling ink flow from an ink source to a printhead, comprising:

a valve body with a chamber therein, the chamber having an input aperture for receiving ink from the ink source and an exit aperture for providing ink to the printhead;

a diaphragm connected to form a subchamber that includes the input aperture and the exit aperture within the chamber; and a plug assembly including a plug for closing a selected one of the apertures, wherein the plug assembly maintains the plug in a normally closed position across the selected aperture plug being integrally formed with the diaphragm; and an actuation mechanism to pull the plug away from the selected aperture.

2. The valve as defined in claim 1, wherein the plug is attached to the diaphragm.

3. The valve as defined in claim 1, wherein the plug is disposed in a normally closed position across the input aperture.

4. The valve as defined in claim 1, wherein the plug assembly is spring-loaded to maintain the plug in the normally closed position.

5. An ink delivery system for an inkjet printer, comprising:

a plurality of ink containers, each ink container having a rigid outer container, a flexible inner ink reservoir, and an interior volume between the rigid outer container and flexible inner ink reservoir for receiving pressurizing gas;

a plurality of ink lines for providing ink to a printing carriage, each ink line fluidically coupled to a flexible inner ink reservoir of an ink container;

a plurality of normally-closed fluid valves, each valve interposed in one of the ink lines;

a valve actuating mechanism mechanically connected to each of the fluid valves for opening the valves when the actuating mechanism is connected to a source of pressurizing gas; and gas lines connecting each of the ink container interior volumes and the valve actuating mechanism to a single common source of pressurizing gas.

6. The ink delivery system for an inkjet printer of claim 5, wherein the valve actuating mechanism further comprises an air cylinder.

7. The system as defined in claim 6, wherein the valve actuating mechanism is a cam that is rotated by the gas cylinder to open the valve.

8. The system as defined in claim 6, wherein the valve actuating mechanism is a lever that is pivoted by the gas cylinder to open the valve.

9. The ink delivery system for an inkjet printer of claim 6, wherein the air cylinder is mechanically connected to drive a rod that is connected to a plurality of mechanisms, each mechanism operable to operate an associated valve.

10. The ink delivery system for an inkjet printer of claim 5, wherein each of said fluid valves comprises:

a valve body with a chamber therein, the chamber having an input aperture for receiving ink from the ink source and an exit aperture for providing ink to the printhead;

a diaphragm connected to farm a subchamber that includes the input aperture and the exit aperture within the chamber; and a plug assembly including a plug for closing a selected one of the apertures, wherein the plug assembly maintains the plug in a normally closed position across the selected aperture; and an actuation mechanism to pull the plug away from the selected aperture.

11. The ink delivery system for an inkjet printer of claim 10, wherein the plug is attached to the diaphragm.

12. The ink delivery system for an inkjet printer of claim 10, wherein the plug is disposed in a normally closed position across the input aperture.

13. The ink delivery system for an inkjet printer of claim 10, wherein the plug assembly is spring-loaded to maintain the plug in the normally closed position.

* * * * *

UNITED STATES PATENT AND TRADEMARK OFFICE

CERTIFICATE OF CORRECTION

PATENT NO. : 7,025,445 B2
APPLICATION NO. : 10/199154
DATED : April 11, 2006
INVENTOR(S) : Jeffrey L. Thielman et al.

It is certified that error appears in the above-identified patent and that said Letters Patent is hereby corrected as shown below:

In column 5, line 36, in Claim 1, delete “aperture” and insert -- aperture, the --, therefor.

In column 6, line 34, in Claim 10, delete “farm” and insert -- form --, therefor.

Signed and Sealed this

Twenty-sixth Day of May, 2009

John Doll

JOHN DOLL
*Acting Director of the United States Patent and Trademark Office*